US011289244B2

(12) United States Patent
Wischnat et al.

(10) Patent No.: US 11,289,244 B2
(45) Date of Patent: Mar. 29, 2022

(54) ELECTRONIC COMPONENT FOR LIMITING THE INRUSH CURRENT

(71) Applicant: EPCOS AG, Munich (DE)

(72) Inventors: Volker Wischnat, Deutschlandsberg (AT); Alfred Hofrichter, Hartberg (AT); Franz Rinner, Deutschlandsberg (AT)

(73) Assignee: EPCOS AG, Munich (DE)

( * ) Notice: Subject to any disclaimer, the term of this patent is extended or adjusted under 35 U.S.C. 154(b) by 573 days.

(21) Appl. No.: 16/090,805

(22) PCT Filed: Apr. 18, 2017

(86) PCT No.: PCT/EP2017/059132
§ 371 (c)(1),
(2) Date: Oct. 2, 2018

(87) PCT Pub. No.: WO2017/186527
PCT Pub. Date: Nov. 2, 2017

(65) Prior Publication Data

US 2020/0118718 A1 Apr. 16, 2020

(30) Foreign Application Priority Data

Apr. 28, 2016 (DE) ..... 102016107931.6

(51) Int. Cl.

| | |
|---|---|
| ***H01C 1/14*** | (2006.01) |
| ***H01C 7/04*** | (2006.01) |
| ***H01C 7/06*** | (2006.01) |
| ***H01C 7/18*** | (2006.01) |
| ***H01C 17/28*** | (2006.01) |

(52) U.S. Cl.
CPC ..... *H01C 1/1413* (2013.01); *H01C 7/041* (2013.01); *H01C 7/043* (2013.01); *H01C 7/06* (2013.01); *H01C 7/18* (2013.01); *H01C 17/281* (2013.01)

(58) Field of Classification Search
CPC ..... H01C 1/1413; H01C 17/281
USPC ..... 29/610.1, 592.1
See application file for complete search history.

(56) References Cited

U.S. PATENT DOCUMENTS

| | | | | |
|---|---|---|---|---|
| 3,311,968 A | 4/1967 | Ardouin et al. | | |
| 3,435,399 A | 3/1969 | Gielisse et al. | | |
| 4,447,799 A * | 5/1984 | Carlson | G01K 7/223 | 29/613 |
| 6,081,416 A | 6/2000 | Trinh et al. | | |
| 6,242,998 B1 * | 6/2001 | Mihara | H01C 1/022 | 338/22 R |

(Continued)

FOREIGN PATENT DOCUMENTS

| | | |
|---|---|---|
| CH | 286248 A | 10/1952 |
| CN | 1134027 C | 1/2004 |

(Continued)

OTHER PUBLICATIONS

EPCOS AG, "NTC thermistors for inrush current limiting," Leaded and coated disks, P27 series, Nov. 2015, 19 pages.

*Primary Examiner* — Peter Dungba Vo
*Assistant Examiner* — Azm A Parvez

(57) ABSTRACT

An electronic component is disclosed. In an embodiment, an electronic component includes at least one NTC element and at least two electrically conductive contact elements, wherein the NTC element is electrically conductively connected to a respective contact element via a connection material, and wherein a coefficient of thermal expansion of the contact elements is adapted to a coefficient thermal expansion of the NTC element.

20 Claims, 5 Drawing Sheets

(56) References Cited

U.S. PATENT DOCUMENTS

| | | | | |
|---|---|---|---|---|
| 7,554,249 | B2 | 6/2009 | Braun et al. | |
| 7,928,828 | B2 | 4/2011 | Kahr | |
| 9,714,869 | B2 | 7/2017 | Satou et al. | |
| 9,829,391 | B2 | 11/2017 | Sohn et al. | |
| 9,972,426 | B2 | 5/2018 | Rinner et al. | |
| 10,395,843 | B2 | 8/2019 | Koini et al. | |
| 2001/0054233 | A1 | 12/2001 | Hamatani et al. | |
| 2015/0116899 | A1* | 4/2015 | Kayatani | H01G 4/30 361/301.4 |
| 2015/0239070 | A1* | 8/2015 | Kuroki | B23K 35/262 428/646 |
| 2015/0259256 | A1 | 9/2015 | Urdl et al. | |
| 2015/0308903 | A1 | 10/2015 | Sohn et al. | |
| 2015/0340907 | A1* | 11/2015 | Lei | B60L 8/003 307/66 |

FOREIGN PATENT DOCUMENTS

| | | | | |
|---|---|---|---|---|
| CN | 101335127 | A | 12/2008 | |
| CN | 105006317 | A | 10/2015 | |
| CN | 105181166 | A | 12/2015 | |
| DE | 620678 | C | 10/1935 | |
| DE | 1640218 | A | 12/1970 | |
| DE | 19848823 | A1 | 6/1999 | |
| DE | 19848823 | A1 * | 6/1999 | H01C 7/04 |
| DE | 10317466 | A1 | 12/2004 | |
| DE | 112011101480 | T5 | 5/2013 | |
| DE | 102012109704 | A1 | 4/2014 | |
| DE | 102014107450 | A1 | 12/2015 | |
| DE | 102014107450 | A1 * | 12/2015 | H01C 1/148 |
| DE | 102015121982 | A1 | 6/2017 | |
| EP | 2189430 | A1 | 5/2010 | |
| JP | S63-138705 | A | 6/1988 | |
| JP | H02161711 | A | 6/1990 | |
| JP | H04070701 | U1 | 6/1992 | |
| JP | H0729667 | A | 1/1995 | |
| JP | 2011222737 | A | 11/2011 | |
| JP | 2013197127 | A | 9/2013 | |
| JP | 2018510507 | A | 4/2018 | |
| WO | 2014056654 | A1 | 4/2014 | |

* cited by examiner

ELECTRONIC COMPONENT FOR LIMITING THE INRUSH CURRENT

This patent application is a national phase filing under section 371 of PCT/EP2017/059132, filed Apr. 18, 2017, which claims the priority of German patent application 10 2016 107 931.6, filed Apr. 28, 2016, each of which is incorporated herein by reference in its entirety.

TECHNICAL FIELD

The invention relates to an electronic component for limiting the inrush current. The invention furthermore relates to the use of an electronic component.

BACKGROUND

Start/stop systems in the automotive sector (automobiles, trucks) represent a significant possibility for saving fuel and are therefore incorporated in almost all new vehicles. In these systems, the inrush current of the starter has to be limited in order to prevent a decrease in the on-board power supply system voltage, in order that safety-relevant applications (ABS, ESP), in particular, are sufficiently supplied.

For the process of starting an internal combustion engine, a thermally controlled inrush current limiter (ICL) can be used for this purpose. When the internal combustion engine is restarted after economy shutdown, the 12 V on-board power supply system is momentarily loaded with up to 1000 A by the current demand of the starter motor. Conventional 12 V batteries are loaded by this additional power to such a great extent that the power supply system voltage decreases by a number of volts. This decrease can lead to the failure of other consumers in the on-board power supply system. In order to avoid that, the voltage decrease has to be avoided or reduced. An NTC (Negative Temperature Coefficient) component, for example, can be used for reducing the voltage decrease.

Given the expected dimensions of more than 1 $cm^2$ cross section and less than 1 mm length of the NTC component, a planar contacting with a low electrical resistance is necessary. Moreover, the component is subjected to great temperature fluctuations during operation, wherein the coefficient of thermal expansion of the ICL ceramic is significantly lower than the coefficient of expansion of good electrical conductors (e. g. copper). The thermal mechanical stresses caused as a result can lead to the destruction of the component.

SUMMARY OF THE INVENTION

Embodiments provide an improved electronic component for limiting the inrush current, and further provide using an improved electronic component.

In accordance with one aspect, an electronic component, component for short, is specified. The electronic component is configured to be used in an inrush current limiter or to act as an inrush current limiter. The component comprises at least one NTC element. The NTC element serves as a functional element or functional layer of the component. The NTC element comprises an NTC ceramic. The component can comprise a multiplicity of NTC elements, for example, two, three, five or ten NTC elements. The NTC element can be configured as disk-shaped or laminar (round). However, the NTC element can also have a rectangular or ring-shaped surface.

A metallization may be arranged on the NTC element, preferably on a top side and on an underside of the NTC element. The metallization preferably comprises silver. As an alternative thereto, the metallization can also comprise copper or gold. The NTC element can be a monolithic component. In this case, the NTC ceramic is produced using pressing technology and then brought to the desired shape and/or to the desired thickness (thick-film monolith) by lapping (fine grinding from both sides). As an alternative thereto, the NTC element can also be configured as a multilayer monolith. In this case, ceramic films are stacked one above another and pressed in order to provide the NTC element.

The component comprises at least two electrically conductive contact elements or electrodes. The contact elements may be configured in a planar fashion. The contact elements are configured and arranged for electrically conductive and thermal connection to the NTC element. The component can comprise a multiplicity of contact elements, for example, five, ten or fifteen contact elements, wherein the individual NTC elements must thereby be well coupled thermally.

The NTC element is electrically conductively connected to the respective contact element via a connection material. The NTC element is also thermally connected to the respective contact element via the connection material. The connection material may form a stable, highly electrically conductive and mechanically durable connection between the NTC element and the contact elements.

The coefficient of thermal expansion of the respective contact element is adapted to the coefficient of thermal expansion of the NTC element. Preferably, the coefficients of thermal expansion of the NTC element and the contact elements are approximately equal.

By way of example, the NTC element has a coefficient of thermal expansion of between 7 ppm/K and 10 ppm/K. Preferably, the respective contact element has a corresponding coefficient of expansion. The coefficient of thermal expansion of the respective contact element is preferably in the range of between 5 ppm/K and 10 ppm/K.

The adaptation of the coefficients of thermal expansion results in a reduction or adaptation of the differences in the material-dictated thermal expansion (CTE) of NTC element and contact elements. As a result, stresses caused by thermal expansion can be reduced or avoided. A particularly stable, reliable and long-lived component is thus made available.

In accordance with an embodiment, the NTC element has a top side and an underside. Top side and underside are situated opposite one another and are bounded in each case by the end sides of the NTC element. The top side and the underside are in each case electrically conductively contacted at least partly by the respective contact element. Depending on the production process, in particular a small marginal layer or a small marginal region of the top side and/or of the underside can remain uncontacted.

However, the top side and the underside can also be electrically conductively contacted in each case over the whole area by means of the respective contact element. In other words, the NTC element is arranged in an embedded manner between the two contact elements, such that top side and underside are covered in each case partly or completely by a contact element. A particularly reliable contacting of the NTC element and a particularly stable connection between NTC element and contact elements can be achieved as a result.

In accordance with an embodiment, the contact element comprises a material composite. In other words, the contact element is composed of a plurality of materials. The respective contact element preferably comprises copper. Copper is distinguished by its very high electrical conductivity and also a very high thermal conductivity. In addition, the contact element preferably comprises invar and/or kovar and/or molybdenum. These materials are distinguished by their low coefficients of thermal expansion. Preferably, the respective contact element comprises a rolled copper-invar sheet with a layer construction comprising copper-invar-copper. Through suitable selection of the thickness ratio of copper and invar/kovar and/or molybdenum layers of the respective contact element, the coefficient of expansion can be adapted to the coefficient of expansion of the NTC element. A very stable and long-lived component is thus achieved.

In accordance with an embodiment, the contact element comprises a layer construction of copper-invar-copper with a thickness ratio of 10%≤copper≤30%-50%≤invar/kovar/molybdenum≤80%-10%≤copper≤30%. That means that the contact element comprises at least three layers. A first layer preferably comprises copper. The first layer has a thickness or vertical extent that is between 1/10 and 3/10 of the total thickness of the contact element. A second layer preferably comprises kovar and/or invar and/or molybdenum. The second layer has a thickness that is between 5/10 and 8/10 of the total thickness of the contact element. The third layer has a thickness that is between 1/10 and 3/10 of the total thickness of the contact element.

That layer of the contact element which comprises invar/kovar/molybdenum may be thicker than that layer of the contact element which comprises copper. The coefficient of expansion of the contact element can thus be reduced or adapted to the coefficient of expansion of the NTC element.

Preferably, the thickness ratio of copper-invar-copper is 20%-60%-20%. It goes without saying that other thickness ratios and other layer sequences and numbers of layers and also the addition of kovar or molybdenum are also conceivable in order to achieve the desired coefficient of expansion.

In accordance with an embodiment, the connection material comprises sintering silver. Sintering silver has a high electrical and thermal conductivity. Furthermore, sintering silver can withstand high temperatures of up to 400° C., for example, 300° C., and also rapid and many temperature changes.

Very high temperatures and a multiplicity of temperature changes can occur in the operating state or hot state of the NTC element. Therefore, the heat resistance and adaptability of the connection material are of the utmost importance. In this case, the hot state denotes a state at a temperature which is greater than that of the NTC element in a basic state. The temperature range between the basic state and the hot state can span, for example, any temperature range between −55° C. and +300° C. or extend over this range. Preferably, the temperature range between the basic state and the hot state can extend over the range of −40° C. to +300° C.

Preferably, the connection material comprises μAg. μAg is distinguished by its sufficient porosity, in particular.

In accordance with an embodiment, the NTC element comprises two, three, five, ten or more segments. The segments of the NTC element preferably constitute rectangular partial regions of the NTC element, which are spaced apart from one another. The distance between the segments is 0.05 mm to 0.2 mm, for example, 0.1 mm. In other words, joints (expansion joints) are situated between the individual segments. By virtue of these expansion joints, no or only low stresses are built up. Additional mechanical stresses can thus be avoided and, consequently, a long-lived component can be made available.

In accordance with an embodiment, the NTC element has a nominal resistance $R_{25}$≤1Ω at a temperature of 25° C. (room temperature). In this case, room temperature is understood to mean the temperature that usually prevails in occupied rooms. The electrical resistance mentioned preferably describes the electrical resistance of the unloaded NTC element between external contacts at an ambient temperature of 25° C.

By way of example, the NTC element at the indicated temperature has a nominal resistance $R_{25}$ of less than or equal to 0.1Ω, preferably less than 0.05Ω. The NTC element consequently has a very low electrical resistance at room temperature or at 25° C. and thus a very high electrical conductivity. The NTC element is thus particularly well suited to use in an inrush current limiter with high current load.

What can be achieved as a result of the low electrical resistance is, in particular, that a sufficiently high inrush current of an electrical consumer, which is connected in series with the electronic component, for example, in a corresponding application, is made available, but is limited to an extent such that, for example, the electrical voltage during the switch-on process is still sufficiently high for the electrical supply of further important electrical components. With the aid of the component, the voltage dip during the starting process for the consumer in comparison with a consumer without the electronic component is preferably reduced by approximately 1 V.

In accordance with an embodiment, the electrical resistivity of the NTC element in a basic state of the electronic component is ≤2 Ωcm. Preferably, the electrical resistivity of the NTC element in a basic state of the electronic component is between 0.1 Ωcm and 1.0 Ωcm, for example, 0.3 Ωcm.

In accordance with an embodiment, the contact element has a thickness d. It preferably holds true that 0.3 mm≤d≤0.8 mm. Preferably, the thickness d of the respective contact element is less than 0.7 mm, for example, 0.6 mm.

In accordance with an embodiment, the component comprises a plurality of NTC elements and contact elements. The plurality of NTC elements can be provided by singulation from a substrate. The NTC elements are connected in parallel with one another. The current-loading capacity and/or current-carrying capacity of the component can be increased by a parallel connection of a plurality of NTC elements. Preferably, the NTC elements are arranged one above another in a stacked fashion. A respective contact element is arranged between two adjacent NTC elements. The NTC elements are well coupled to one another thermally via the contact elements.

In accordance with an embodiment, the NTC element has the composition $La_{(1-x)}EA_{(x)}Mn_{(1-a-b-c)}Fe_{(a)}CO_{(b)}Ni_{(c)}O_{(3\pm\delta)}$. In this case, 0≤x≤0.5 and 0≤(a+b+c)≤0.5. EA denotes an alkaline earth metal element. Preferably, the alkaline earth metal element is selected from magnesium, calcium, strontium or barium. δ denotes the deviation from the stoichiometric oxygen ratio (oxygen surplus or oxygen deficit). Preferably, |δ|≤0.5. Particularly preferably, |δ|=0.

By virtue of this composition, an NTC element is provided which is distinguished by an extraordinarily high electrical conductivity and a sufficient B value (thermistor constant). By means of (one) specific thickness and (one) specific cross section or area of the NTC element, it is possible to further vary and control the resistance. The NTC element has a thickness d. It preferably holds true that 100 μm≤d≤600 μm. Preferably, the thickness d of the NTC element is less than 500 μm, for example, 400 μm. The B value $B_{25/100}$ is in the range of between 1000 K and 4000 K, preferably between 1400 K and 2000 K, for example, 1500 K.

In accordance with an embodiment, the component comprises a securing element. The securing element is preferably configured and arranged to produce an electrically conductive connection to battery lines. The securing element is furthermore preferably configured and arranged to produce a mechanical connection to battery lines. The securing element is furthermore preferably configured and arranged to provide an—indirect—mechanical connection between the contact elements.

The securing element can be configured to form a screw connection. However, the securing element can, for example, also be configured to form a clamping connection. The securing element can furthermore comprise a sealing element. The sealing element can be configured as insulating or partly insulating. The securing element can comprise at least one nut and one screw and/or at least one clamping element, for example, two clamping elements.

The securing element has an electrical resistance. The electrical resistance may be equal to or only slightly higher than the resistance of the NTC element at low operating temperatures. In particular, the electrical resistance of the securing element is equal to or only slightly higher than the resistance of the NTC element at the lowest operating temperature, e.g., −40° C.

The resistance of the securing element may be not temperature-dependent. As a result, even in the case of a fault (e. g. breaking of the conductive connection between NTC element and contact element), it is still possible to start the motor (depending on the design of the starter system). The voltage dip is likewise avoided, but the electrical power available for starting is greatly limited, as a result of which the starting process is significantly delayed under certain circumstances. Besides a screw joint, it is also possible to use a fixed resistor or some other conductive element having a defined electrical resistance as securing element.

In accordance with a further aspect, the use of an electronic component is described. Preferably, the use of the component described above is specified. All features which have been explained in association with the component are also applicable to the use, and vice versa.

In particular, the use of the above-described component for start/stop systems in the automotive sector is specified. The inrush current during switch-on is limited by the temperature-dependent resistance (NTC element). Upon switch-on, the NTC element immediately heats up as a result of the inrush current (e. g. to 250° C.), as a result of which the NTC resistance rapidly decreases down to a very small residual resistance (e. g. 0.5 mΩ). On account of the specific properties of the NTC element, this dynamic change in resistance reduces the current spike caused by the starter motor, which simultaneously reduces the voltage dip of the battery. An effective component for limiting the inrush current in start/stop systems is thus provided.

The provided contact elements and the connection material furthermore may realize a very low-resistance electrical connection of the NTC element to the contact elements for repeated switching cycles, in which the ambient temperature can fluctuate from −40° C. to 120° C. During the switching cycle, the temperature can rise to up to 300° C. A stable, highly electrically conductive component with mechanically durable, temperature-resistant and extremely loadable connection between NTC element and contact elements for use for start/stop systems in the automotive sector is thus specified.

In accordance with a further aspect, the use of an electronic component, in particular of the electronic component described above, for currents up to 1000 A at DC voltage in 12 V and 24 V power supply systems is specified.

BRIEF DESCRIPTION OF THE DRAWINGS

The invention is explained in greater detail below on the basis of embodiments and the associated figures.

The drawings described below should not be regarded as true to scale. Rather, for the sake of better illustration, individual dimensions may be illustrated in an enlarged, reduced or even distorted manner.

Elements which are identical to one another or which perform the same function are designated by identical reference signs.

Figure 1:
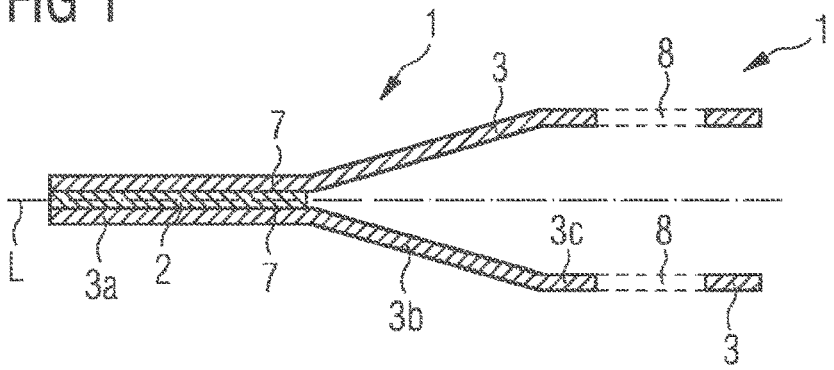
Figure 2:
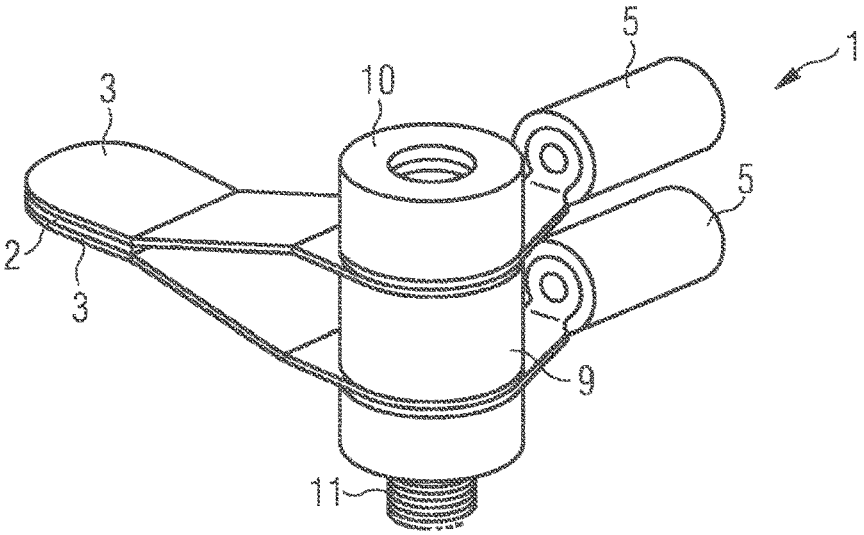
Figure 3:
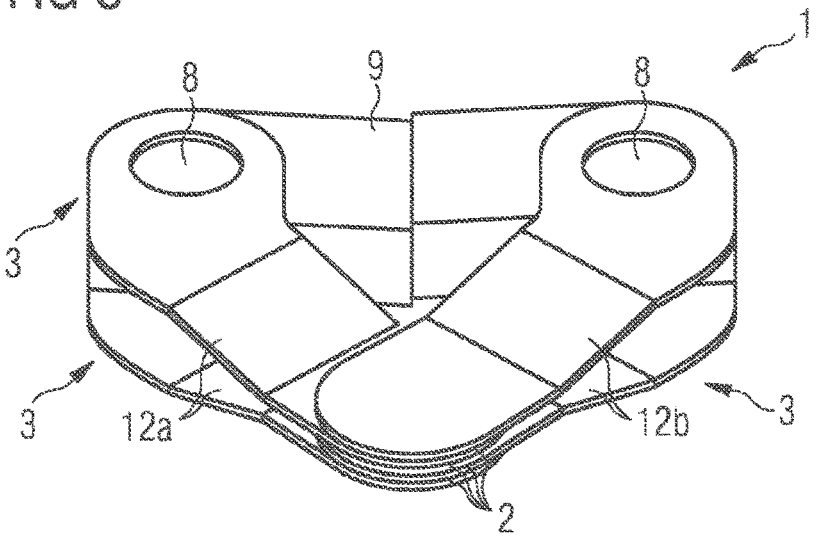
Figure 4:
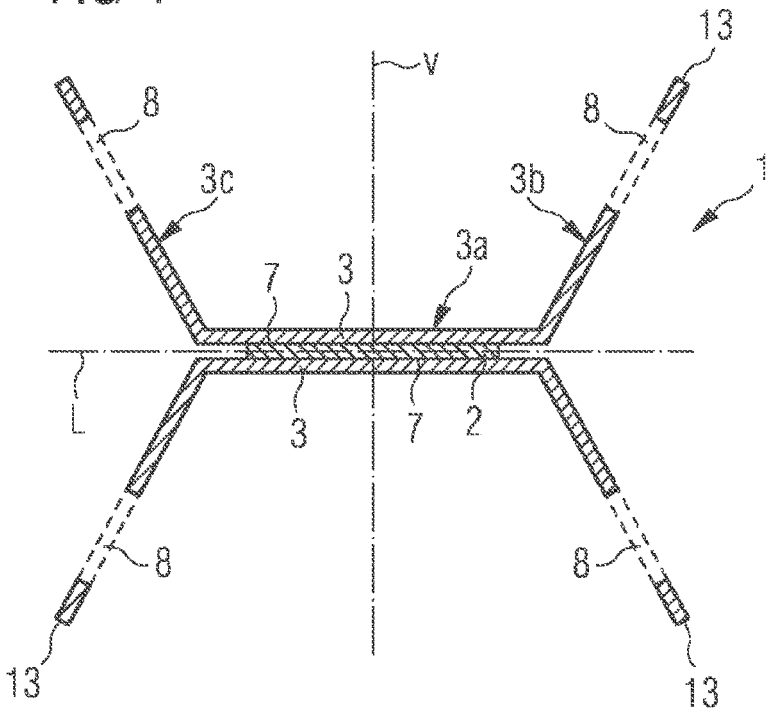
Figure 5:
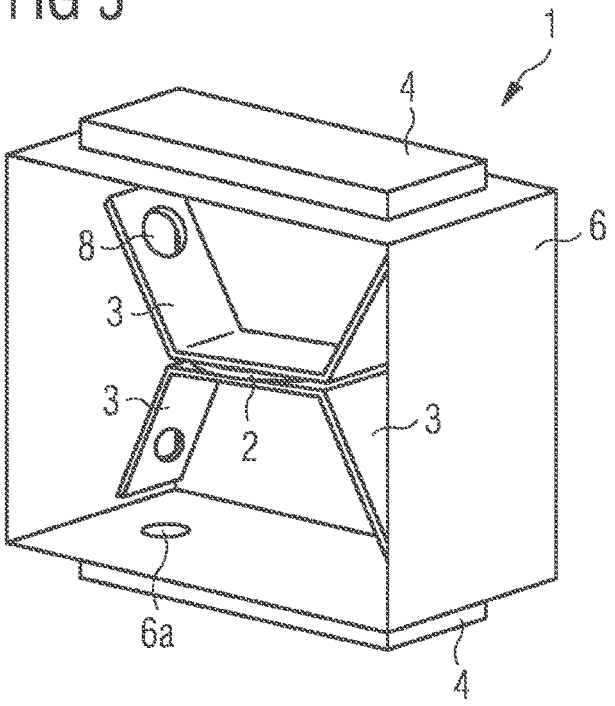
Figure 6:
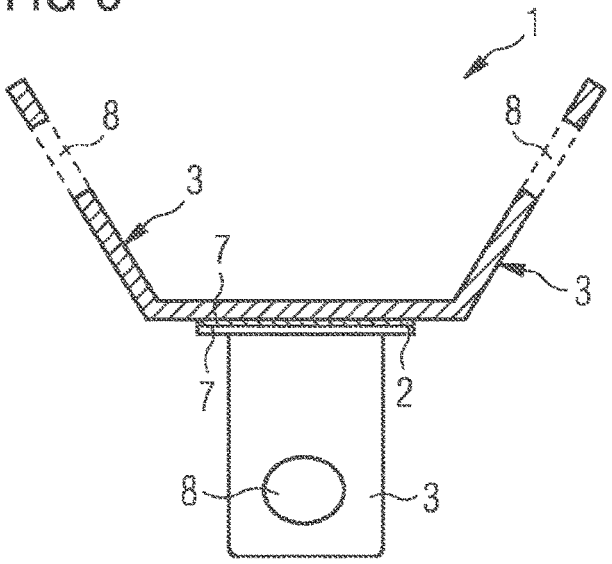
Figure 7:
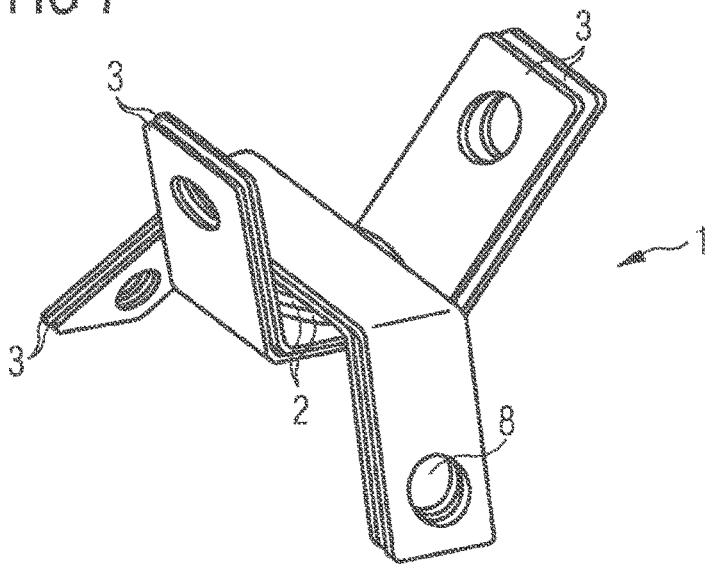
Figure 8:
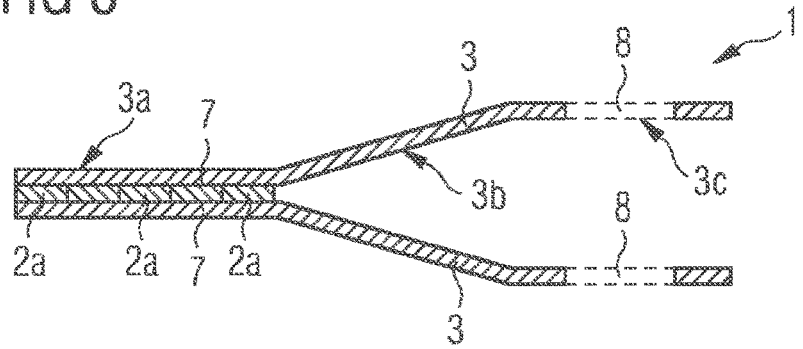
Figure 9:
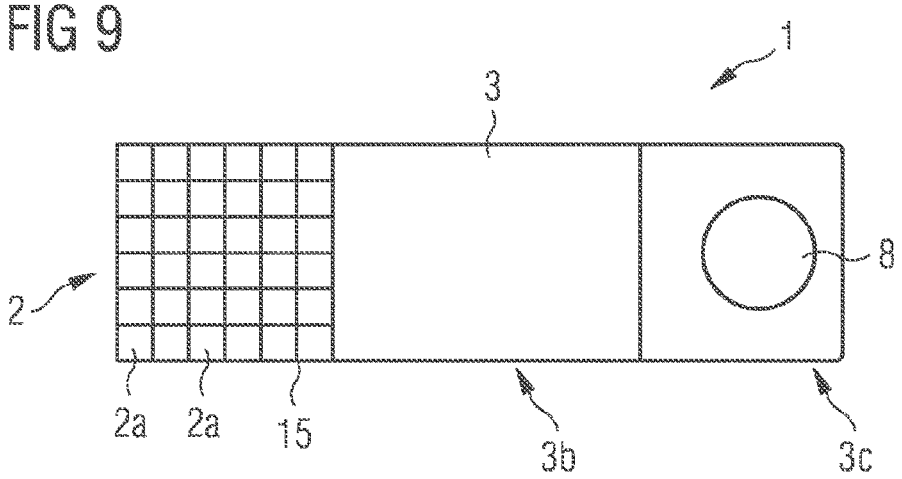
Figure 10:
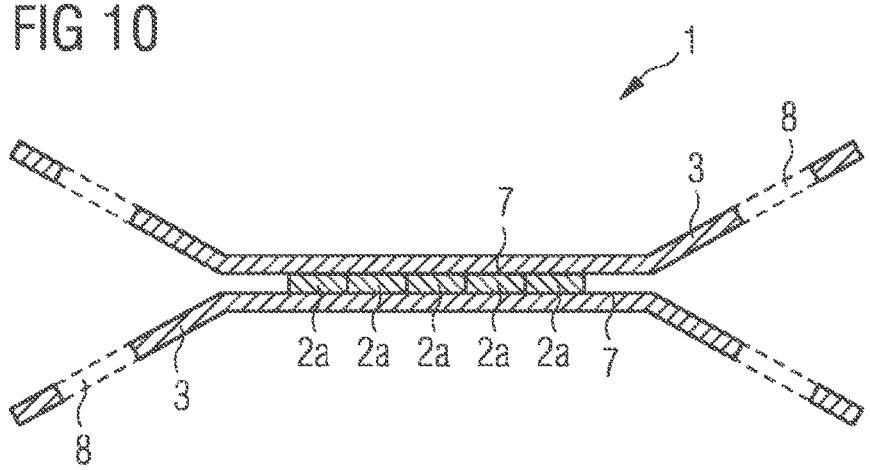
Figure 11:
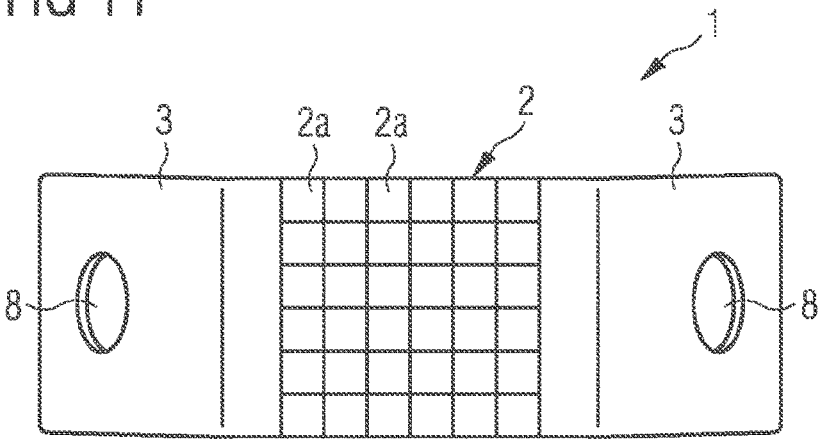
Figure 12:
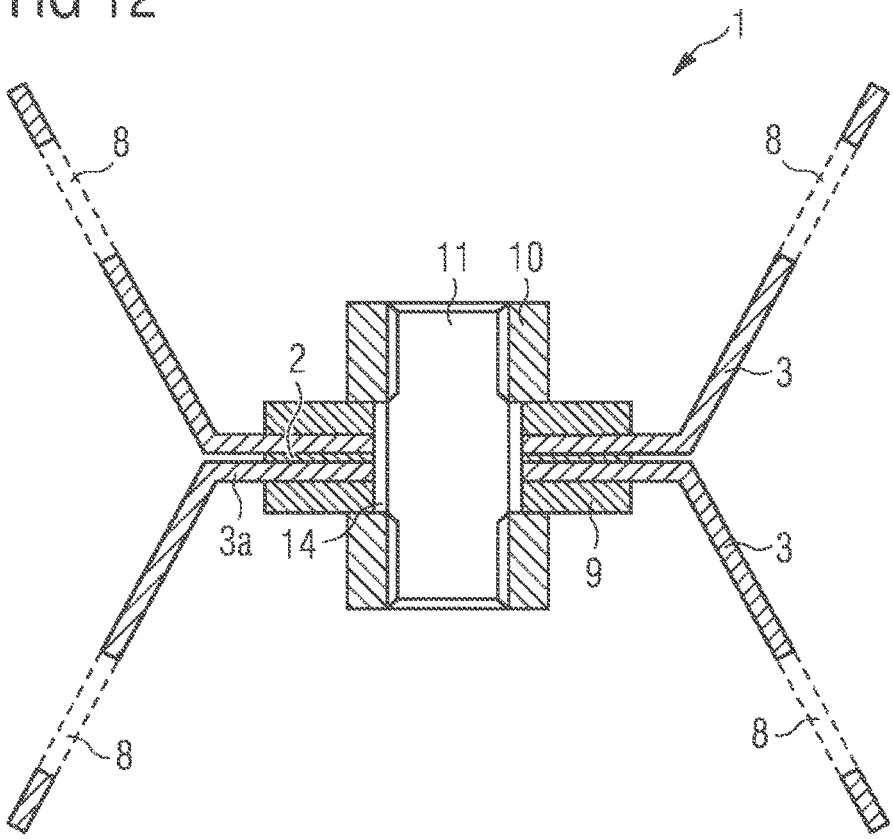
Figure 13:
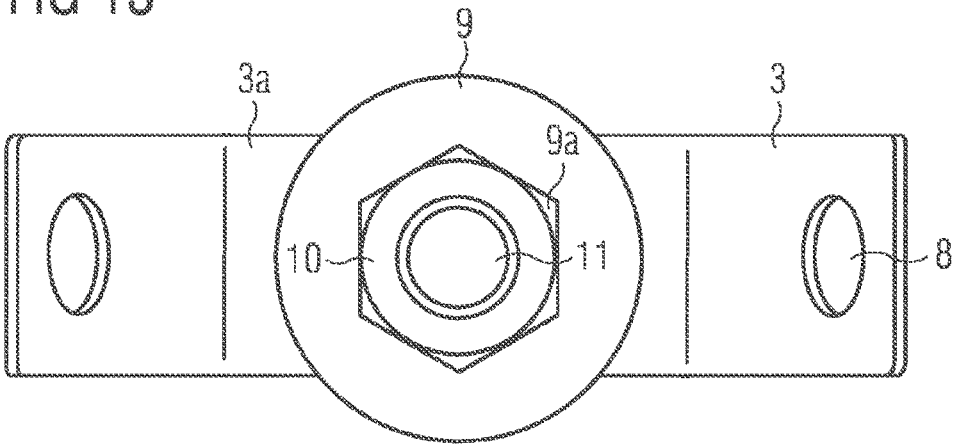

FIG. 1 shows a schematic sectional view of an electronic component;

FIG. 2 shows a perspective view of a possible contacting of the electronic component in accordance with FIG. 1;

FIG. 3 shows a perspective view of an electronic component in accordance with a further embodiment;

FIG. 4 shows a schematic sectional view of an electronic component in accordance with a further embodiment;

FIG. 5 shows a perspective view of a possible contacting of the electronic component in accordance with FIG. 4;

FIG. 6 shows a schematic sectional view of an electronic component in accordance with a further embodiment;

FIG. 7 shows a perspective view of an electronic component in accordance with a further embodiment;

FIG. 8 shows a schematic sectional view of an electronic component in accordance with a further embodiment;

FIG. 9 shows a plan view of a partial region of the electronic component in accordance with FIG. 8;

FIG. 10 shows a schematic sectional view of an electronic component in accordance with a further embodiment;

FIG. 11 shows a plan view of a partial region of the electronic component in accordance with FIG. 10;

FIG. 12 shows a schematic sectional view of an electronic component in accordance with a further embodiment; and FIG. 13 shows a plan view of a partial region of the electronic component in accordance with FIG. 12.

DETAILED DESCRIPTION OF ILLUSTRATIVE EMBODIMENTS

FIG. 1 shows an electronic component 1, component 1 for short. The component 1 is configured to be used as an inrush current limiter or in an inrush current limiter for start/stop systems in 12 V and 24 V power supply systems in the automotive sector. The component 1 is suitable in particular for a use for currents of up to 1000 A (at DC voltage in 12 V and 24 V power supply systems). The component 1 is suitable for being used in typical 12 V starter motors with a power of approximately 1 kW to 3 kW.

The component 1 comprises an NTC element 2 or an NTC ceramic. The NTC element 2 constitutes a functional layer or a functional element of the component 1. The NTC element 2 is a thermally conductive component having a negative temperature coefficient.

The NTC element 2 has a material composition which is distinguished by a high electrical conductivity or a low resistivity.

The NTC element 2 preferably has the following composition: $La_{(1-x)}EA_{(x)}Mn_{(1-a-b-c)}Fe_{(a)}CO_{(b)}Ni_{(c)}O_{(3\pm\delta)}$. In this case, it holds true that $0 \leq x \leq 0.5$ and $0 \leq (a+b+c) \leq 0.5$. EA denotes an alkaline earth metal element, for example, Mg, Ca, Sr or Ba. δ denotes the deviation from the stoichiometric oxygen ratio (oxygen surplus or oxygen deficit). Preferably, $|\delta| \leq 0.5$; particularly preferably, $|\delta|=0$. By way of example, the NTC ceramic has the composition $La_{0.95}Sr_{0.05}MnO_3$.

The electrical resistivity of the NTC element 2 in a basic state of the NTC element 2 is less than or equal to 2 Ωcm, preferably ≤1 Ωcm, for example, 0.5 Ωcm. In this case, the basic state describes a temperature of the NTC element 2 of 25° C. or at room temperature. The basic state can be an unloaded state in which, for example, no electrical power is applied to the NTC element 2.

The NTC element 2 at the indicated temperature has an electrical resistance (nominal resistance $R_{25}$) of less than or equal to 1Ω, preferably less than 0.1Ω, for example, 0.05Ω. The NTC element 2 consequently has a low electrical resistance at room temperature or at 25° C. and thus a high electrical conductivity. The NTC element 2 is thus particularly well suited to use in an inrush current limiter.

The NTC element 2 furthermore has a high B value. The B value $B_{25/100}$ is in the range of between 1000 K and 4000 K, preferably between 1400 K and 2000 K, for example, 1500 K. The NTC element 2 has a low coefficient of thermal expansion. Typically, the coefficient of thermal expansion of the NTC element 2 is between 7 ppm/K and 10 ppm/K.

The NTC element 2 is preferably configured as a monolithic component. By way of example, the NTC element 2 is a thick-film monolith. In this case, the NTC element 2 is produced using pressing technology and then brought to the desired thickness by lapping (fine grinding from both sides). As an alternative thereto, however, the NTC element 2 can also be configured as a multilayer monolith. In this case, ceramic films are stacked one above another and pressed in order to provide the NTC element 2.

The NTC element 2 illustrated in FIG. 2 has a round shape. The NTC element 2 is configured as disk-shaped or laminar. However, other shapes are also conceivable for the NTC element 2, for example, a rectangular shape or a ring shape. The NTC element 2 can be configured in the form of a substrate. The NTC element 2 has an area of between 25 $mm^2$ and 500 $mm^2$, for example, 200 $mm^2$. The diameter of the NTC element 2 is, for example, less than or equal to 14 mm, e.g., 13.75 mm. The NTC element 2 has a thickness d of between 100 μm and 600 μm, for example, 400 μm. By varying thickness d and/or cross section or area of the NTC element 2, it is possible to vary and control the resistance of the NTC element 2.

The NTC element 2 has a metallization (not explicitly illustrated). The metallization is preferably arranged at a top side and at an underside of the NTC element 2. Preferably, the metallization comprises fired silver.

The component 1 furthermore comprises two contacts 3 or contact elements 3 (positive contact and negative contact elements 12*b*, 12*a*, see FIG. 3). The contact elements 3 serve for the electrical contacting of the NTC element 2. In this embodiment, the contact elements 3 bear over the whole area on the top side and the underside of the NTC element 2. As an alternative thereto (not explicitly illustrated) a narrow marginal region of top side and underside can also remain free of the respective contact element 3.

The contact elements 3 are electrically conductively connected respectively to the top side and the underside of the NTC element 2. Preferably, the NTC element 2 and the contact elements 3 are sintered together.

For this purpose, the component 1 comprises a connection material 7. A respective layer of connection material 7 is formed between the top side of the NTC element 2 and the first contact element 3 and between the underside of the NTC element 2 and the second contact element 7. The layer thickness of the connection material 7 is preferably in the range of between 15 μm and 80 μm, for example, 20 μm.

The connection material 7 is distinguished by a high electrical and thermal conductivity. The connection material 7 is furthermore preferably distinguished by a high porosity. The connection material 7 is furthermore distinguished by the fact that it can withstand high temperatures of up to 400° C., e. g. 300° C., and many and rapid temperature changes that can occur during operation or in the hot state of the component 1.

In this case, the hot state denotes a state of the component 1 at a temperature which is greater than that of the component 1 in the basic state. The temperature range between the basic state and the hot state can span, for example, any temperature range between −55° C. and +300° C. or extend over this range. Preferably, the temperature range between the basic state and the hot state can extend over the range of −40° C. to +300° C.

By way of example, the connection material 7 comprises sintering silver Ag or μAg. Sintering silver has the advantage that it has a sufficient porosity. A stable, highly electrically conductive and mechanically durable connection between the NTC element 2 and the contact elements 3 is achieved with the aid of the connection material 7.

The respective contact element 3 has a high thermal and electrical conductivity. The respective contact element 3 is furthermore configured such that thermal stresses between the NTC element 2 and the contact element 3 are reduced. In particular, the respective contact element 3 is configured to decrease or reduce the differences in the material-dictated thermal expansion (CTE).

Preferably, the respective contact element 3 comprises a material composite. The respective contact element can be configured as composite sheet material, for example. The material composite can comprise copper-invar-copper (CIC). Instead of invar, it is also possible to use kovar or molybdenum as material. Invar or kovar or molybdenum respectively has a low coefficient of thermal expansion. Typically, the coefficient of thermal expansion of these materials is ≤10 ppm/K, for example, 7 ppm/K. The coefficient of expansion of kovar/invar/molybdenum is thus very similar to the coefficient of expansion of the NTC element 2. Through a suitable selection of the thickness ratio of the layers of the material composite, the coefficient of expansion of the contact element 3 can be adapted well to the coefficient of expansion of the NTC element 2. Thermal stresses can be reduced or avoided.

In this embodiment, the respective contact element 3 is a rolled copper-invar sheet with a layer construction comprising copper-invar-copper of 20%-60%-20%. However, other ratios of copper and invar or kovar/molybdenum are also conceivable. In particular, depending on the required area of the NTC element 2 and the required thermal conduction resistance, other layer sequences and layer thicknesses can also be used.

The contact elements 3 enclose the NTC element 2 in the shape of tongs. In this case, a first partial region 3*a* of the respective contact element 3 bears against the top side or underside, respectively, of the NTC element 2 and extends parallel to the top side or underside, respectively, of the NTC element 2 or to a longitudinal axis L of the component 1. A length or horizontal extent of the NTC element 2 is preferably less than or equal to the length or horizontal extent of the first partial region 3*a*.

A second partial region 3*b* of the respective contact element 3 forms an angle with the longitudinal axis L. The second partial region 3*b* adjoins the first partial region 3*a*, preferably at an angle of ≤20°, for example, 15°, with respect to the longitudinal axis L of the component 1. The angle between the second partial region 3*b* of the first contact element 3 and the second partial region 3*b* of the second contact element is preferably less than or equal to 40°, for example, 30°. A third partial region 3*c* of the respective contact element 3 adjoins the second partial region 3*b* and extends parallel to the longitudinal axis L.

In this embodiment, the respective partial regions 3*a*, 3*b*, 3*c* preferably have the same length. By way of example, the partial regions 3*a*, 3*b*, 3*c* each have a length of 10 mm to 15 mm. The respective partial regions 3*a*, 3*b*, 3*c* preferably have the same thickness d. By way of example, the partial regions 3*a*, 3*b*, 3*c* each have a thickness d of less than or equal to 0.8 mm and greater than or equal to 0.3 mm. Consequently, the thickness d of the respective contact element 3 amounts to 0.3 mm≤d≤0.8 mm, for example, d=0.7 mm.

The partial regions 3*a*, 3*b*, 3*c* merge into one another. In other words, the partial regions 3*a*, 3*b*, 3*c* are not embodied as separate regions or component parts, but rather merely constitute subsections of the respective contact element 3.

The respective contact element 3, in particular the third partial region 3*c*, has a cutout 8. Preferably, for this purpose the third partial region 3*c* has a larger horizontal extent or a larger area than the first and second partial regions 3*a*, 3*b* (see FIG. 3, for example). The cutout 8 is preferably configured as circular. The cutout 8 has a diameter of 8 mm, for example. The cutout 8 penetrates completely through the contact element 3. The cutout 8 serves to connect the component 1 to battery lines by means of a securing element, as will be explained in greater detail, for example, in conjunction with FIG. 2.

FIG. 2 shows a possible contacting of the component 1 in accordance with FIG. 1 with the battery lines via cable lugs.

The component 1 comprises a securing element for producing the electrical contacting of the component 1 and in particular for mechanically securing battery lines to the component 1. The securing element can be configured for providing a screw connection as described below. As an alternative thereto, the securing element can also be configured and arranged to produce a clamping connection.

A spacer 9 is arranged between the first and second contact elements 3. The spacer 9 is arranged between an underside of the third partial region 3*c* of the first or upper contact element 3 and the top side of the third partial region 3*c* of the second or lower contact element 3. The spacer 9 is configured as cylindrical.

The spacer 9 is configured as insulating. The spacer 9 serves for electrical insulation between the two contact elements 3 (positive contact element 12*b* and negative contact element 12*a*, see FIG. 3). The spacer 9 comprises polytetrafluoroethylene (PTFE), for example. PTFE has the advantage that it is insulating in a resistant manner up to a temperature of approximately 250° C. Preferably, the spacer 9 has a cutout (not explicitly illustrated) that penetrates completely through the spacer 9 in a vertical direction. The cutout serves for receiving a connection element, e. g. a threaded rod 11, for example, a screw.

A respective nut 10 is arranged at the top side of the first contact element 3 and the underside of the second contact element 3. Threaded rod 11 and nuts 10 serve for screwing together the contact elements 3 and for electrically conductively and mechanically connecting the component 1 to the battery lines (not explicitly illustrated). As an alternative thereto, clamping elements, for example, are provided for clamping together the contact elements 3 and/or for electrically conductively and mechanically connecting the component 1 to the battery lines (not explicitly illustrated).

Cable lugs 5 are arranged between the battery lines (not illustrated) and the contact elements 3, a copper cable (not illustrated) being secured at said cable lugs. The cable lugs 5 are electrically conductively connected to the contact elements 3. For connecting the component 1 to the cable lugs 5, the threaded rod 11 is led through the nuts 10, the cutout 8 in the respective contact element 3 and the cutout in the spacer 9.

In this case, the screwing on one axis avoids additional mechanical stresses on the connection between the NTC element 2 and the contact elements 3. The screwing or securing arrangement either has to have a higher resistance than the NTC element 2 or has to be embodied in an insulating fashion (see FIGS. 12 and 13, for example). Alternatively, the screwing or securing can also be affected directly to a ground contact at the vehicle or of the starter motor.

The inrush current during switch-on is limited by the temperature-dependent resistance of the component 1. Upon switch-on, the NTC element 2 immediately heats up as a result of the inrush current (e. g. to 250° C.), as a result of which the NTC resistance rapidly decreases down to a very small residual resistance (e. g. 0.5 mΩ). This dynamic change in resistance reduces the current spike caused by the starter motor, which simultaneously reduces the voltage dip of the battery. A stable, long-lived and efficient component for limiting the inrush current is thus made available.

The component 1 can additionally be equipped with a so-called "fail-safe" function. To that end, the screw joint shown in FIG. 2 is embodied such that its electrical resistance is equal to or only slightly higher than the resistance of the NTC element 2 at the lowest operating temperature, e. g. −40° C. The resistance of this screw joint is not temperature-dependent. As a result, even in the case of a fault (e. g. breaking of the conductive connection between NTC element 2 and contact element 3), it is still possible to start the motor (depending on the design of the starter system). The voltage dip is likewise avoided, but the electrical power available for starting is greatly limited, as a result of which the starting process is significantly delayed under certain circumstances.

By way of example, the electrical resistivity of the NTC element 2 at 25° C. is: $R_{res,25}$=0.2 Ωcm. The nominal resistance $R_{25}$ of the NTC element 2 at a temperature of 25° C. is, for example, $R_{25}$=10 mΩ. The B value is 1650 K, for example. For an electrical resistivity of the NTC element 2 at a temperature of −40° C. of $R_{res,-40}$=0.65 Ωcm and for a resistance of the NTC element 2 of 32 mΩ, this results in an electrical resistance of the screw joint of preferably 32 to 35 mΩ.

As an alternative to a screw joint, it is also possible to use a fixed resistor or some other conductive element having a defined electrical resistance.

FIG. 3 shows a perspective view of an electronic component in accordance with a further embodiment. In contrast to the component 1 from FIG. 1, the component 1 in accordance with FIG. 3 comprises a plurality of NTC elements 2 and also a plurality of contact elements 3.

The component 1 can comprise up to ten NTC elements 2. The NTC elements 2 are configured in each case as round or disk-shaped (see explanations concerning FIG. 1). The NTC elements 2 are electrically connected in parallel.

The contact elements 3 are arranged between the NTC elements 2. The component 1 preferably comprises a layer sequence comprising alternately arranged NTC elements 2 and contact elements 3 (positive contact elements 12*b* and negative contact elements 12*a*). A good thermal connection of the individual NTC elements 2 is achieved as a result of the planar "stacked" succession of contact element 3/NTC element 2/contact element 3/NTC element 2, etc. This good thermal connection enables a uniform heating of the NTC elements 2.

The diameter of the NTC elements 2 can be smaller than the diameter of the NTC element 2 illustrated in FIG. 1. That is to say that a plurality of smaller elements are connected. In this case, the stresses decrease with the component size of the NTC element 2.

The securing at the, preferably the screwing to the, battery terminals is preferably effected on a common, insulating body (for example, a spacer 9), in order to avoid additional mechanical stresses on the connection between the NTC elements 2 and the contact elements 3.

All further features of the component 1 in accordance with FIG. 3, in particular material, structure and functioning of NTC elements 2 and contact elements 3 and also the connection thereof via the connection material 7, and the functioning of the component 1, correspond to the features described in conjunction with FIG. 1.

FIG. 4 shows a schematic sectional view of an electronic component in accordance with a further embodiment.

Only the differences with respect to the component 1 from FIG. 1 are described below. In particular, the features concerning the embodiment of the NTC element 2 and also the connection of NTC element 2 and contact elements 3 from FIG. 1 also find application for the component 1 from FIG. 4.

In this embodiment, the contact elements 3 are embodied in double-sided fashion. Here, too, the respective contact element 3 has three partial regions 3*a*, 3*b*, 3*c*, wherein second partial region 3*b* and third partial region 3*c* are embodied such that they are of identical type but in an opposite direction with respect to the first partial region 3*a*.

The first partial region 3*a* bears against the top side or underside, respectively, of the NTC element 2 and extends parallel to the top side or underside, respectively, of the NTC element 2 or to the longitudinal axis L. The length or horizontal extent of the NTC element 2 is less than or equal to the length or horizontal extent of the first partial region 3*a*. Preferably, the length of the first partial region 3*a* in this embodiment is greater than the length of the first partial region 3*a* in accordance with the embodiment shown in FIG. 1. The length of the first partial region 3*a* is 18 mm, for example. The diameter of the NTC element 2 is, for example, less than or equal to 14 mm, e. g. 13.75 mm.

The second and third partial regions 3*b*, 3*c* each adjoin a side region or marginal region of the first partial region 3*a*. In other words, the second partial region 3*b* and the third partial region 3*c* are in each case configured in a manner adjoining the first partial region 3*a* on the left and right.

The second partial region 3*b* and the third partial region 3*c* each form an angle with the longitudinal axis L. The second and third partial regions 3*b*, 3*c* preferably each form an angle of ≤90°, for example, 60°, with the longitudinal axis L. Both the second partial region 3*a* and the third partial region 3*c* extend away from the longitudinal axis L. A vertical distance from an end region 13 of the third partial region 3*c* or of the second partial region 3*b*, respectively, to the NTC element 2 is, for example, less than or equal to 18 mm, for example, 15 mm.

The component 1 is embodied mirror-symmetrically about the axis L. The respective contact element 3 is furthermore configured mirror-symmetrically about a vertical axis V.

By virtue of the embodiment described above, e. g. the electrical and thermal resistance of the contact elements 3 can be halved with the same contact material. A further advantage of this embodiment is the avoidance of different temperatures in the NTC element 2 as a result of "one-sided" heat dissipation via the contact elements 3 as in the case of the embodiment in accordance with FIG. 1, for example.

All further features of the component 1 in accordance with FIG. 4 correspond to the features described in conjunction with FIG. 1.

FIG. 5 shows a perspective view of a possible contacting of the electronic component in accordance with FIG. 4.

In this case, the component 1 is introduced into a housing 6. The housing 6 is configured in the shape of a frame. Through the housing 6, the component 1 is contacted (screwed, clamped or the like) by means of an insulated, flexible copper cable (not explicitly illustrated). In this case, the contacting is effected as described in conjunction with FIG. 2 via the nuts 10, the threaded rod 11, which is introduced into the cutout 8 of the respective contact element 3, and the electrically conductive connection of the contact elements 3 to cable lugs, in which the copper cables are introduced. In this case, the copper cables are introduced into the housing 6 via cutouts 6*a* at a top side and an underside of the housing 6.

The housing 6 has a mechanical strain relief 4 for the copper cables. The strain relief 4 can be arranged, for example, at a top side and an underside 4 of the housing 6. In the event of mechanical tension on the copper cables, the strain relief 4 ensures that no or only slight forces act on the component 1, and in particular the connection material 7. Consequently, the component 1 is preferably held in a stress-free manner by the strain relief 4.

FIG. 6 shows a schematic sectional view of an electronic component in accordance with a further embodiment.

The component 1 substantially corresponds to the component 1 from FIG. 4. However, in this embodiment, the contact elements 3 are not arranged mirror-symmetrically with respect to the longitudinal axis L. Rather, the contact elements 3 are offset by 90° with respect to one another. Different installation situations can thus be taken into account.

All further features of the component 1 in accordance with FIG. 6 correspond to the features described in conjunction with FIG. 4.

FIG. 7 shows a perspective illustration of an electronic component in accordance with a further embodiment.

The component 1 substantially corresponds to the component 1 from FIG. 6. However, the component 1 in accordance with FIG. 7 comprises a plurality of NTC elements 2 and also a plurality of contact elements 3. The component 1 can comprise up to ten NTC elements 2, which are each configured as round or disk-shaped and are electrically connected in parallel. The contact elements 3 are arranged between the NTC elements 2. Thus, as already described in conjunction with FIG. 3, the component 1 comprises a layer sequence comprising alternately arranged NTC elements 2 and contact elements 3.

FIG. 8 shows a schematic sectional view of an electronic component in accordance with a further embodiment. FIG. 9 furthermore shows a plan view of a partial region of the electronic component in accordance with FIG. 8.

In contrast to the embodiment in accordance with FIG. 1, in this case an NTC element 2 is used which has been divided or segmented into smaller NTC elements or segments 2*a* by sawing or scribing. The NTC element 2 has a plurality of segments 2*a*.

In order to form the segments 2*a*, the NTC element 2 preferably has a rectangular shape, unlike in FIG. 1. By way of example, the NTC element 2 has a width and a height of in each case less than or equal to 13 mm, for example, 12.7 mm. The respective segment 2*a* is likewise preferably embodied in rectangular fashion. Preferably, the respective segment 2*a* has a length and also a width of in each case approximately 2 mm.

The contact elements 3 should also be embodied in rectangular fashion for this embodiment. In this regard, the respective contact element in accordance with FIGS. 8 and 9 is formed from three rectangular partial regions 3*a*, 3*b*, 3*c*. The three partial regions preferably have the same length, for example, 15 mm.

Gaps or expansion joints 15 are formed between the individual segments 2*a* (see FIG. 9). The expansion joints 15 have a width of 0.05 mm to 0.2 mm, for example, 0.1 mm. By virtue of said expansion joints 15, lower thermal stresses are built up in the NTC element 2 during operation as intended.

For the production of this embodiment variant, ceramic multilayer technology is appropriate, wherein an NTC substrate comprising stacked ceramic films is segmented by so-called "dicing" before or after metallization. All further features correspond to the features described in conjunction with FIG. 1.

FIG. 10 shows a schematic sectional view of an electronic component in accordance with a further embodiment. FIG. 11 shows a plan view of a partial region of the electronic component in accordance with FIG. 10.

This embodiment combines features of the embodiments in accordance with FIGS. 4 and also 8 and 9. In particular, the contact elements 3 are embodied in double-sided fashion—as described in conjunction with FIG. 4. The NTC element 2 is separated into individual segments 2*a*—as described in conjunction with FIGS. 8 and 9. All further features correspond to the features described in conjunction with FIGS. 4, 8 and 9.

FIG. 12 shows a schematic sectional view of an electronic component in accordance with a further embodiment. FIG. 13 shows a perspective view of a partial region of the electronic component in accordance with FIG. 12.

In this embodiment, the contact elements 3 are configured in double-sided fashion, as described in conjunction with FIG. 4. The NTC element 2 is arranged between the first partial region 3*a* of the contact elements 3 and is electrically conductively and thermally connected to the contact elements 3 via the connection material 7.

In this embodiment, the screw joint is embodied in an insulating fashion, in contrast to the screw joint in accordance with FIG. 2. For this purpose, the NTC element 2 is embodied in a ring-shaped fashion. In other words, the NTC element 2 has a round, continuous cutout. The first partial region 3*a* of the respective contact element 3 also has a cutout in this embodiment. The cutouts of contact elements 3 and NTC element 2 are configured and arranged to enable the contact elements 3 to be screwed together in an insulating fashion. In particular, the cutouts are provided for introducing a threaded rod 11 for the purpose of screwing together the contact elements 3.

A respective spacer 9 is arranged on an outer surface of the first partial region 3*a*, said spacer having a cutout 9*a* (FIG. 13). The respective spacer is a PTFE disk, for example. The respective spacer has a diameter of 15 mm, for example. In this case, a spacer 9 is arranged on a top side of the first partial region 3*a* of the first or upper contact element 3. A further spacer 9 is arranged on an underside of the first partial region 3*a* of the second or lower contact element 3. A respective nut 10 is arranged on the spacers 9. The threaded rod 11 is led through the nuts 10, the cutouts in the spacers 9, the NTC element 2 and the contact elements 3 for the purpose of screwing together the contact elements 3. Between the threaded rod 11 and the NTC element 2, an insulating element 14 is introduced into the cutout of the NTC element 2. The insulating element 14 can comprise $AlO_x$, for example. By way of example, the insulating element 14 is a small $AlO_x$ tube. A screw joint of the component 1 that is embodied in an insulating fashion is thus made possible.

The electrical contacting of the component 1 is effected once again, as described in conjunction with FIG. 2, via the electrically conductive connection of the contact elements 3 to the battery lines via the cable lugs 5. In this case, the cable lugs are screwed to the contact elements 3 via the cutouts 8 of the contact elements 3.

The invention is not restricted by the description on the basis of the embodiments. Rather, the invention encompasses any novel feature and also any combination of features, which in particular includes any combination of features in the patent claims, even if this feature or this combination itself is not explicitly specified in the patent claims or embodiments.

The invention claimed is:

1. An electronic component comprising:

at least one Negative Temperature Coefficient (NTC) element; and at least two electrically conductive contact elements, wherein the NTC element is electrically conductively connected to a respective contact element via a connection material, and wherein a coefficient of thermal expansion of the contact elements is approximately equal to a coefficient of thermal expansion of the NTC element, wherein the NTC element comprises $La_{(1-x)}EA_{(x)}Mn_{(1-a-b-c)}Fe_{(a)}Co_{(b)}Ni_{(c)}O_{(3\pm\delta)}$, wherein $0 \le x \le 0.5$ and $0 \le (a+b+c) \le 0.5$, wherein EA denotes an alkaline earth metal element and δ denotes a deviation from a stoichiometric oxygen ratio, wherein the alkaline earth metal element EA is selected from the group consisting of magnesium, calcium, strontium and barium, and wherein $|\delta| \le 0.5$.

2. The electronic component according to claim 1, wherein the contact elements comprise a layer construction of copper-invar/kovar-copper with a thickness ratio of 10%≤copper≤30%-50%≤invar/kovar≤80%-10%≤copper≤30%.

3. The electronic component according to claim 1, wherein the NTC element has a nominal resistance $R_{25} \le 1\Omega$ at a temperature of 25° C.

4. The electronic component according to claim 1, wherein the NTC element has a top side and an underside, and wherein the top side and the underside are electrically conductively contacted at least partly by the respective contact element.

5. The electronic component according to claim 1, wherein the contact elements comprise a material composite.

6. The electronic component according to claim 1, wherein the contact elements comprise copper and invar or kovar.

7. The electronic component according to claim 1, wherein the connection material comprises sintering silver.

8. The electronic component according to claim 1, wherein the NTC element comprises two, three or more segments.

9. The electronic component according to claim 1, wherein an electrical resistivity of the NTC element in a basic state of the electronic component is ≤2 Ωcm.

10. The electronic component according to claim 1, wherein the contact elements have a thickness d, and wherein 0.3 mm≤d≤0.8 mm.

11. The electronic component according to claim 1, wherein the NTC element has a thickness d, and wherein 100 μm≤d≤600 μm.

12. The electronic component according to claim 1, wherein the electronic component comprises a plurality of NTC elements and a plurality of contact elements, and wherein the NTC elements are connected in parallel with one another.

13. The electronic component according to claim 12, wherein the NTC elements are arranged one above another in a stacked fashion, wherein a respective contact element is arranged between two adjacent NTC elements, and wherein the NTC elements are thermally coupled to one another via the contact elements.

14. The electronic component according to claim 1, wherein the NTC element has a coefficient of thermal expansion of between 7 ppm/K and 10 ppm/K.

15. The electronic component according to claim 1, further comprising a securing element, wherein the securing element has an electrical resistance which is equal to or only slightly higher than a resistance of the NTC element at low operating temperatures.

16. An electronic component comprising:

at least one Negative Temperature Coefficient (NTC) element;

at least two electrically conductive contact elements, wherein the NTC element is electrically conductively connected to a respective contact element via a connection material, and wherein a coefficient of thermal expansion of the contact elements is approximately equal to a coefficient thermal expansion of the NTC element; and a securing element, wherein the securing element has an electrical resistance, wherein the electrical resistance of the securing element is equal to or only slightly higher than an electrical resistance of the NTC element at low operating temperatures, and wherein the securing element is configured to provide an electrical connection so that an electrical power is still be transferable through the electronic component in a limited amount when a conductive connection between the NTC element and the contact elements breaks.

17. The electronic component according to claim 16, wherein the NTC element has a top side and an underside, and wherein the top side and the underside are electrically conductively contacted at least partly by the respective contact element.

18. The electronic component according to claim 17, wherein the NTC element has a nominal resistance $R_{25}$≤1Ω at a temperature of 25° C.

19. The electronic component according to claim 16, wherein the contact elements have a thickness d, and wherein 0.3 mm≤d≤0.8 mm.

20. The electronic component according to claim 19, wherein the NTC element has a thickness d, and wherein 100 μm≤d≤600 μm.

* * * * *